United States Patent [19]

Shanks

[11] 4,425,607

[45] Jan. 10, 1984

[54] SEALED BEAM LAMP UNIT

[75] Inventor: Bruce E. Shanks, Chesterland, Ohio

[73] Assignee: General Electric Company, Schenectady, N.Y.

[21] Appl. No.: 346,303

[22] Filed: Feb. 5, 1982

[51] Int. Cl.[3] ..... F21V 29/00

[52] U.S. Cl. ..... 362/267; 362/158; 362/307; 362/308; 362/310; 362/311; 362/374; 313/113

[58] Field of Search ..... 313/113; 362/267, 158, 362/374, 307, 308, 310, 311

[56] References Cited

U.S. PATENT DOCUMENTS 4,240,131 12/1980 Albrecht ..... 362/267

*Primary Examiner*—Stephen J. Lechert, Jr.

*Attorney, Agent, or Firm*—John F. McDevitt; Philip L. Schlamp; Fred Jacob

[57] ABSTRACT

An adhesively sealed beam lamp unit including a lens and reflector having substantially rectangular peripheries and cooperating and opposing step-shaped sealing surfaces located approximately about the lens and reflector peripheries. Contact between the lens and reflector sealing surfaces is limited to one or more portions along the long sides of a pair of opposing steps. Additionally reservoirs, located on either side of the sealing surfaces, restrict excess adhesive from spreading onto areas affecting lamp unit optical performance or outer dimensions.

9 Claims, 8 Drawing Figures

Fig. 4
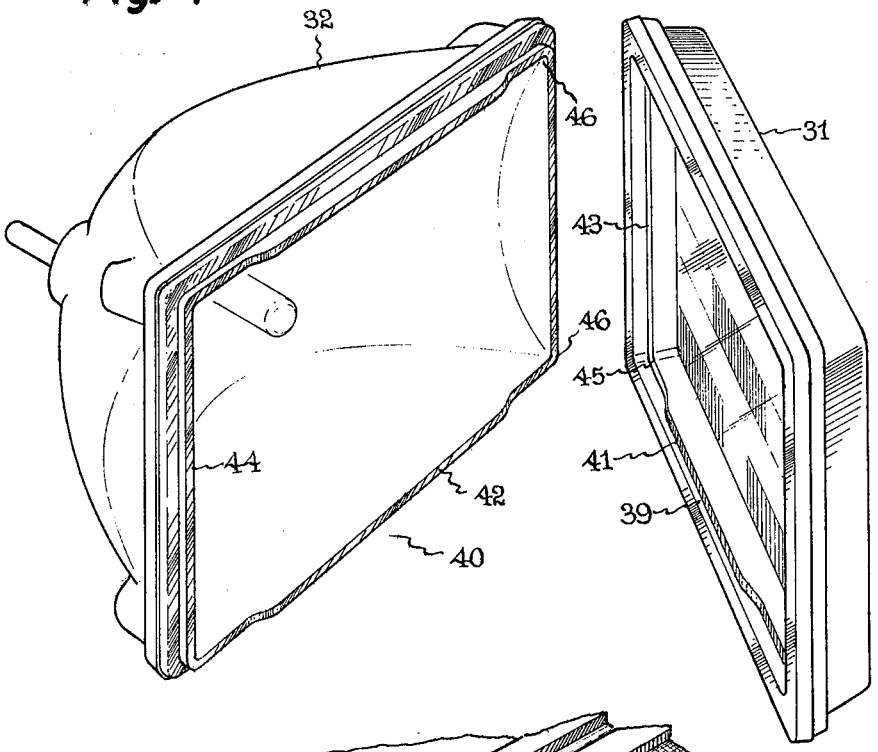
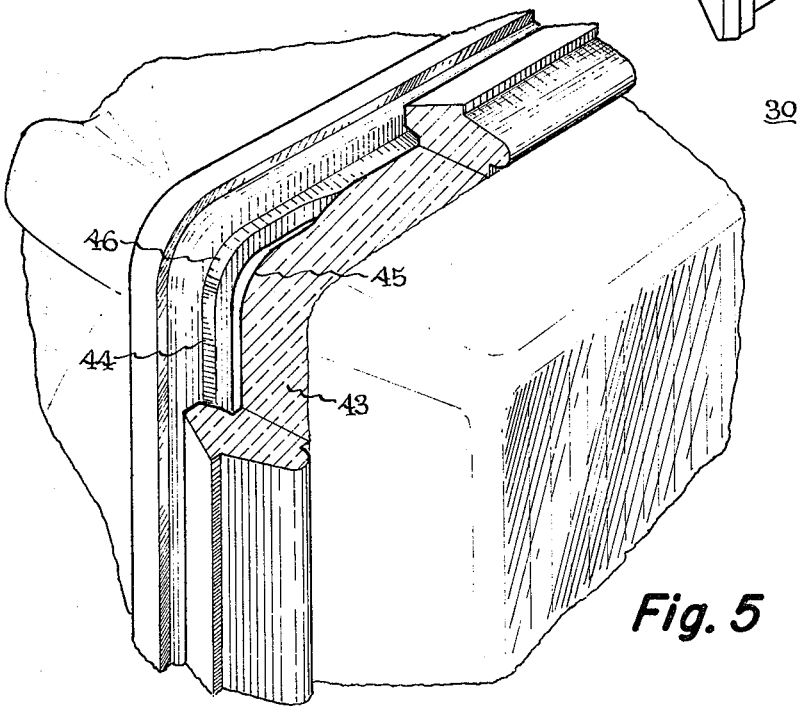
Fig. 5

SEALED BEAM LAMP UNIT

CROSS-REFERENCE TO RELATED APPLICATION

U.S. Pat. application Ser. No. 346,302 Joseph P. Marella and Bruce E. Shanks, filed concurrently herewith, for "Sealed Beam Lamp Unit" and assigned the same as this invention.

BACKGROUND OF THE INVENTION

The present invention is related to lamps, particularly sealed beam lamp units, having two-piece envelopes comprising a reflector and lens assembled by adhesive means. The reflector has an internal reflective coating for reflecting and directing light, originating from a light source located within the envelope, towards a cooperating lens through which the light is transmitted. Such sealed beam lamps have particular utility and are commonly used as headlights for motor vehicles.

Lamp units, such as headlights, recently have been introduced with lenses and reflectors having rectangular shaped peripheries, supplanting the more familiar circular units. Production of assembled rectangular glass reflectors and lenses, however, can present numerous problems. For example, stresses created in the glass lenses and reflectors during assembly by fusion sealing can cause cracking thereof. Such stresses can be significantly reduced by using an adhesive, rather than fusion, to seal the glass reflector and lens together. However, the ambient temperature, particularly at cold temperatures, can produce additional stresses resulting in cracks especially about the reflector corners. Thus, the inherent problem of thermally induced stresses experienced when dissimilar materials, such as glass and adhesive, are joined remains.

More particularly, typical coefficients of thermal expansion for glass, such as borosilicate, and of a suitable adhesive for bonding lamp glassware, such as an epoxy, which has been flexibilized by the incorporation of a polymer, can differ by a factor of about 10. Thus, the glass-adhesive seal when exposed to a decreasing ambient temperature can have glass portions thereof contracting at a much different rate than the adhesive portions thereof. Such variations in contraction create stresses, especially around the reflector corners, resulting in spalling of the adhesive to glass interface and cracking of the glass.

Additionally, if any portion of the adhesive flows onto the light-transmitting area of the lens or light-reflecting area of the reflector, or beyond the lamp unit periphery during assembly of the unit, undesirable and unacceptable lamp unit optical performance and/or peripheral dimensions can result.

SUMMARY OF THE INVENTION

In view of the foregoing, it is an object of the present invention to provide a new and improved, substantially rectangular shaped, adhesively sealed beam lamp unit by reducing the stresses generated about the sealing surfaces thereof.

Another object of the present invention is to provide a new and improved, substantially rectangular shaped, adhesively sealed beam lamp unit having means to ensure that excess adhesive does not undesirably affect lamp unit optical performance or dimensions.

These and other objects of the present invention are achieved by providing a lamp unit comprising a reflector and lens having substantially rectangular peripheries and cooperating and opposing step-shaped sealing surfaces, located approximately about the lens and reflector peripheries, with adhesive disposed thereon and substantially contained therebetween. Contact between the lens and reflector sealing surfaces is limited to one or more portions along the long sides of a pair of opposing sealing surface steps. Additionally, to restrict adhesive from flowing onto optically undesirable areas of the lens and/or reflector and to maintain acceptable lamp unit outer dimensions, reservoirs, located on either side of the sealing surfaces, are provided.

BRIEF DESCRIPTION OF THE DRAWING

FIG. 4 illustrates a perspective view of the lens and reflector sealing surfaces in accordance with the present invention.

FIG. 5 is a perspective, fragmentary view illustrating the gap between the innermost pair of opposing sealing surface steps along the short sides and corners thereof.

DETAILED DESCRIPTION

Figure 1:
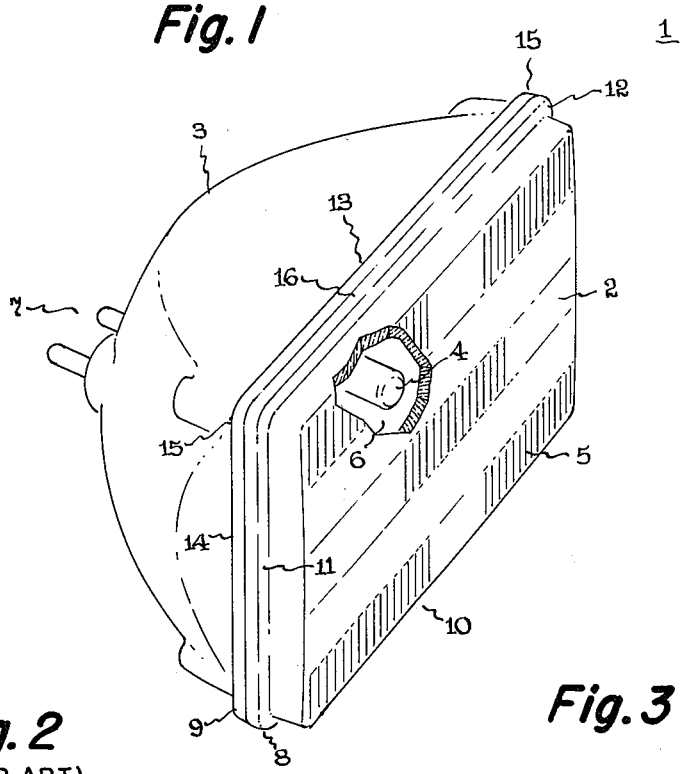
FIG. 1 illustrates a perspective view of a rectangular lamp unit in accordance with the present invention.

FIG. 1 illustrates a rectangular lamp unit such as a headlamp unit 1 having a lens 2, cooperating reflector 3 and light source 4. Both lens 2 and reflector 3 can be formed by pressing "hard" glass in a mold followed by an annealing process. The lens 2 and/or reflector 3 also can be made from other materials such as, but not limited to, quartz and plastic. Lens 2 typically has a slightly convex outer face and an optical prescription provided, for example, by light refracting prisms 5 formed on the inside surface thereof. Additionally the concave inner surface 6 of the reflector 3 has a light-reflective coating typically comprised of aluminum or silver. At the outer rear of the reflector 3 are conventional electrical prongs 7, providing an electrical path through which power is supplied to the unit 1.

As further illustrated in FIG. 1, lens 2 and reflector 3 have substantially rectangular peripheries and sealing surfaces 8 and 9 located approximately about these peripheries, respectively. Lens 2 has longer sides 10, shorter sides 11, and corners 12. Likewise, reflector 3 has corresponding longer sides 13, shorter sides 14 and corners 15.

As previously discussed, fusion sealing, induced, for example, by a flame trained on the glass reflector and lens sealing surfaces 8 and 9, can create unacceptable stress patterns, in particular, with stresses tending to concentrate about the reflector corners 15, resulting in cracks especially thereat. The stresses created by flame sealing are substantially eliminated by interposing an adhesive 16 between the peripheral sealing surfaces 8 and 9 to seal the lens 2 to the reflector 3. For example, a light-curable, flexibilized epoxy, such as disclosed in U.S. Pat. No. 4,240,131, incorporated herein by reference thereto, provides a reliable seal between the glass lens 2 and glass reflector 3. Another example of an acceptable adhesive is "UNISET 929" which is a heat-curable adhesive sold by Amicon Corp. of Lexington, Mass.

Figure 2:
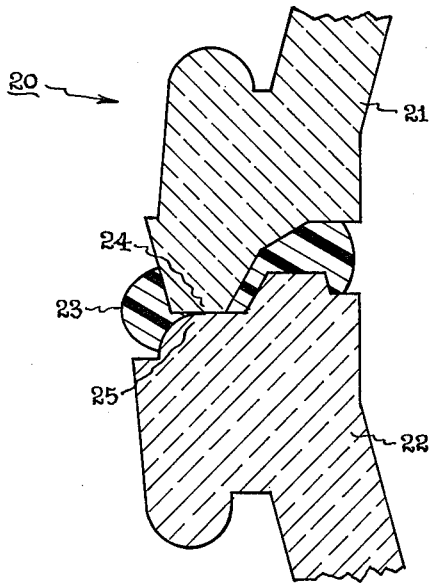
Fig. 2 (PRIOR ART)
FIG. 2 illustrates a fragmentary, cross-sectional view of prior art lens and reflector sealing surfaces.

Although adhesive sealing substantially eliminates stresses created by fusion sealing, an additional type of stress due to thermal affects remains. For example, FIG. 2 illustrates a cross-sectional view of a prior art, adhesively sealed beam lamp unit 20, comprising a glass lens sealing surface 21 and a glass reflector sealing surface 22 with adhesive 23 disposed thereon and therebetween. The sealing surfaces 21 and 22 are located about the rectangular peripheries of the glass lens and reflector respectively. During assembly of the lamp unit 20, adhesive 23 is placed between the sealing surfaces 21 and 22. When pressure is applied to the sealing surfaces 21 and 22 during the manufacturing process of the lamp unit 20, a significant amount of adhesive 23 between the outermost sealing surface sections 24 and 25 is pressed away therefrom resulting in contact therebetween and especially around the short sides and corners of the lamp unit 20. Such contact can create unacceptable stress patterns particularly around the reflector corners. Additionally, the adhesive 23 when forced from between sealing surface sections 24 and 25 can flow beyond the designed lamp unit outer dimensions resulting in an oversized and unacceptable lamp unit.

Furthermore, contact between sealing surface sections 24 and 25 is aggravated by the different coefficients of thermal expansion of glass and adhesive. For example, the coefficient of thermal expansion for borosilicate glass, conventionally used in sealed beam automotive headlamps, typically is about $40\times10^{-7}$ cm/cm/°C. whereas the coefficient of thermal expansion of a typical flexibilized epoxy, suitable for sealing lamp glassware, typically is about $40\times10^{-6}$ cm/cm/°C. That is, the coefficients of thermal expansion of glass and adhesive, in a sealed beam lamp unit can differ, by a factor of about 10. Therefore, temperature changes, in particular decreasing temperatures, produce different rates of contraction for the glass and interposed adhesive creating more stress between the sealing surfaces and thereby aggravating the glass lens to glass reflector contact along those outermost sealing surface sections 24 and 25 where the adhesive has been pressed away. In certain instances, spalling of the adhesive and glass can occur. Even worse, the glassware can crack producing unacceptable lamp performance.

Figure 3:
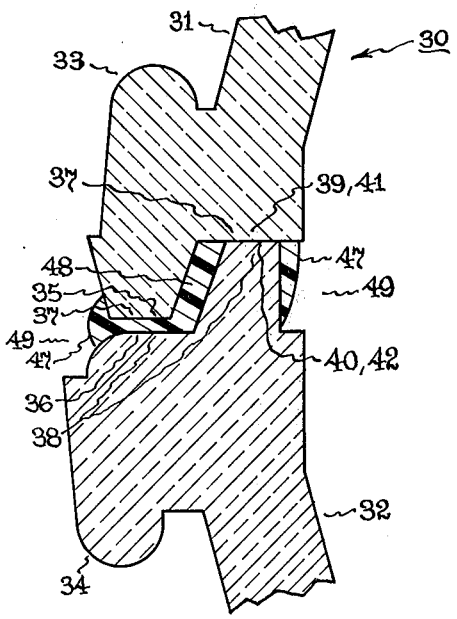
FIG. 3 illustrates a fragmentary, cross-sectional view of lens and reflector sealing surfaces along the long sides thereof in accordance with the present invention.

The present invention significantly reduces such stresses, especially around the reflector corners 15, by modifying such unacceptable stress patterns. FIG. 3 which is fragmentary, cross-sectional view of the lens and reflector sealing surfaces, along the long sides of the lamp unit 30, illustrates the present invention in detail. Lamp unit 30 includes a lens 31 and reflector 32, each having a rectangular periphery, with external molding lobes 33 and 34, respectively, which aid in the molding thereof. Both lens sealing surface 35 and reflector sealing surface 36, which are approximately located about the periphery of the lens 31 and reflector 32, respectively, cooperate with and oppose each other and are substantially multi-stepped in shape including steps 37 and 38 thereof, respectively. Steps 37 and 38 are generally substantially level and substantially transverse to the lamp unit axis. As part of the lens steps 37 and reflector steps 38 are cooperating and opposing innermost steps 39 and 40, respectively, located nearest the interior of the lamp unit 30. As shown in a perspective view, FIG. 4 illustrates that, innermost steps 39 and 40 comprise long sides 41 and 42, short sides 43 and 44, and corners 45 and 46 of the lens 31 and reflector 32, respectively.

Referring once again to FIG. 3, lamp unit 30 is assembled by disposing an adhesive, such as a heat curing adhesive 47, on and between the innermost sealing surface steps 39 and 40. The lens 31 and reflector 32 are then pressed together such that long sides 41 and 42 are mated with each other to thereby cooperate with and oppose each other. It should be noted, that since FIG. 3 illustrates a cross-sectional view of the sealing surfaces 35 and 36 along the long sides of the lamp unit, that the innermost steps 39 and 40 and long sides 41 and 42 are one and the same. The lens-reflector assembly is then placed in an oven and brought to and kept at a requisite curing temperature until the adhesive is cured. As sealing surface steps 39 and 40 are pressed together and/or during curing of the adhesive, adhesive 47 flows from therebetween covering and substantially contained within the remainder of the sealing surfaces 35 and 36. In particular, the gap 48, between the planes of sealing surface steps has a sufficient volume to hold most of the adhesive not disposed on and between the sealing surface steps. Furthermore, reservoirs 49, located on either side thereof, retain any excess adhesive, which oozes from between the sealing surfaces 35 and 36, and thereby prevent the adhesive 47 from spreading onto undesirable portions of the lamp unit 30. That is, the reservoirs enable application of sufficient adhesive to ensure an acceptable peripheral seal without such adhesive oozing onto the lens light-transmitting portions, such as the lens prisms 5, and/or the reflector light-reflecting portions, such as the reflector inner surface 6, or beyond the designed lamp unit outer periphery.

During assembly of the lamp unit 30, steps 37 and 38 serve several functions. First by pairing together, the steps 37 and 38 aid in the alignment of lens 31 to reflector 32. Additionally, by fitting together, the steps 37 and 38 prevent the lens 31 from slipping off the reflector 32 and thereby restrict lateral movement of lens 31 relative to reflector 32. Most importantly, and as will be disclosed below, the steps 37 and 38, and more specifically, innermost steps 39 and 40 serve to alter the stress pattern experienced in prior art, adhesively sealed beam lamp units and thereby substantially reduce the number of cracks that can occur, especially about the lamp unit corners.

Of particular importance and as shown in FIG. 3, the adhesive layer 47 between the sealing surfaces 35 and 36 varies in thickness. Along portions of the long sides 41 and 42 of the innermost steps 39 and 40, respectively, however, the adhesive layer can be so thin that pockets, void of adhesive, can form therein resulting in lens-reflector contact thereat. Such pockets are due to adhesive 47 having been pressed away from between the long sides 41 and 42 during assembly of the lamp unit 30. It is to be emphasized, however, that such lens-reflector contact is limited specifically to one or more portions along the opposing long sides 41 and 42.

Furthermore the short sides 43 and 44 and corners 45 and 46 of the innermost pair of opposing steps are on a lower plane than the long sides 41 and 42 thereof. That is, and as illustrated in FIG. 5, as compared to the short sides and corners of each innermost step, the long sides thereof appear as plateaus, rising gradually to a height ranging from approximately 0.1 to 0.4 millimeters therefrom. Therefore, once lamp unit 30 is assembled, opposing short sides 43 and 44 and corners 45 and 46 are unable to come into contact with each other due to the space formed therebetween.

Figure 6:
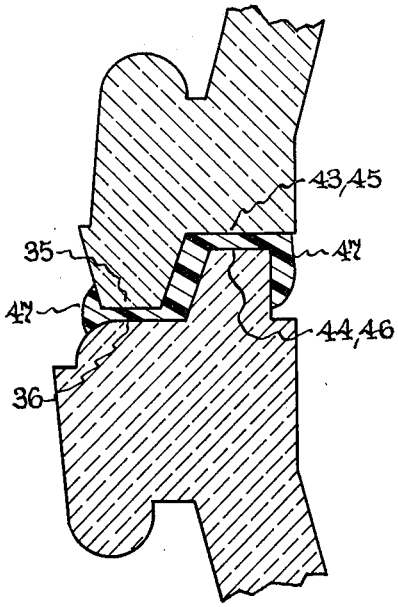
FIG. 6 is a fragmentary, cross-sectional view of lens and reflector sealing surfaces along the short sides and corners thereof in accordance with the present invention.

A fragmentary, cross-sectional view of the short sides or corners of the present invention is shown in FIG. 6. Spacing between the sealing surfaces 35 and 36 prevents contact therebetween including along the short sides 43 and 44 and corners 45 and 46 of the innermost pair of opposing steps. Still further, and as can be seen in FIGS. 3 and 6, between all pairs of opposing steps, excluding portions along the long sides of the innermost pair of opposing steps 39 and 40 of FIG. 3, a space exists with adhesive 47 disposed therein. In other words, the present invention limits contact to one or more portions of the long sides 41 and 42, exclusively. In particular, the present invention eliminates the prior art practice of the lens and reflector outermost sealing surface sections contacting each other about the lamp unit corners where stresses tend to concentrate.

By the present invention isolating lens-reflector contact to one or more portions along the long sides of the innermost pair of opposing steps 39 and 40, stresses generated in the present invention are substantially reduced, as compared to the prior art, and thereby substantially eliminate cracks about the sealing surfaces and especially about the reflector corners. Theoretical explanation accounting for this significant change in the stress pattern is not fully understood, however, test results demonstrate a substantial elimination of cracks, in particular, during decreasing ambient temperatures.

Figure 7:
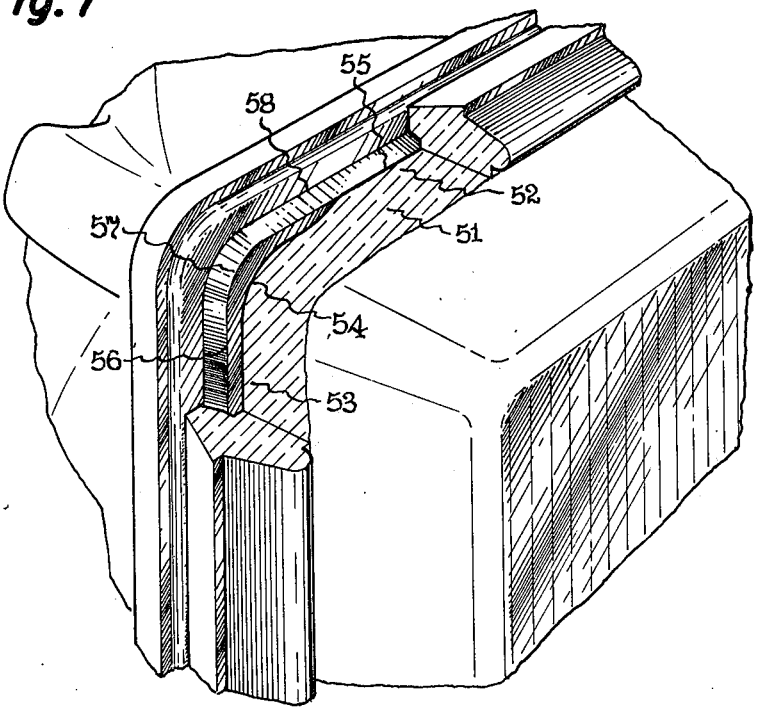
FIG. 7 is an alternative embodiment of the present invention illustrating a perspective view of the lens and reflector sealing surfaces.

FIG. 7 illustrates an alternative embodiment of the present invention wherein only one of the innermost pair of opposing steps need have a lower level along the short sides and corners thereof and a higher level along the long sides thereof. For example, the lens innermost step 51 can have the long sides 52 at a higher level than the short sides 53 and corners 54 which are on a common lower plane. In contrast thereto, the long sides 55, short sides 56 and corners 57 of the reflector innermost step 58 can be on the same plane. In either embodiment, as illustrated in FIG. 5 or 7, contact between the sealing surfaces is limited to the long sides of the innermost steps thereof.

Additionally and as commonly experienced in the art, the lens can warp along its long sides resulting in the lens having a much more convex outer face. Such warpage, however, does not affect the present invention inasmuch as a sufficient space is provided between the sealing surfaces to ensure that only the long sides of the innermost pair of opposing steps can come into contact with each other. That is, the short sides and corners of the lens sealing surfaces, even when such warpage occurs, are unable to come into contact with the corresponding and opposing reflector sealing surface sides and corners.

Figure 8:
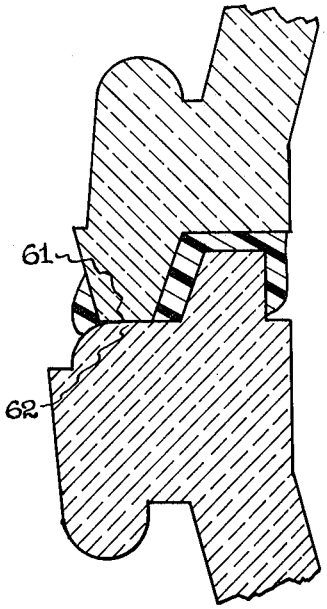
FIG. 8 illustrates a fragmentary, cross-sectional view of another alternative embodiment in accordance with the present invention.

It also is to be noted that although the present invention has for purposes of description limited contact between one or more portions along the long sides of the innermost pair of opposing steps, that contact limited to one or more portions along the long sides of any pair of opposing steps including the outermost pair thereof can be used and be within the scope of this invention. Thus, and as shown in FIG. 8, the opposing pair of outermost steps 61 and 62 can be used to substantially reduce the stresses generated about the sealing surfaces. The essential point is that contact between the sealing surfaces is limited to the long sides of one pair of opposing steps.

Therefore, while preferred embodiments of the invention have been shown and described, various other embodiments and modifications thereof will become apparent to persons skilled in the art and fall within the spirit and scope of the invention as defined in the following claims.

What I claim as new and desire to secure by Letters Patent of the United States is:

1. A sealed beam lamp unit comprising a lens and reflector having substantially rectangular peripheries, cooperating and opposing step-shaped sealing surfaces characterized by long and short sides and corners, located approximately about said peripheries, and spaced apart, so as to provide physical contact between said sealing surfaces limited to one or more portions along said long sides, and further including reservoirs located on either side of said sealing surfaces, with adhesive disposed thereon and therebetween except for said one or more portions which are in physical contact with each other, and said reservoirs containing excess adhesive which has oozed from between said sealing surfaces.

2. A sealed beam lamp unit as defined in claim 1 wherein said pair of opposing steps is located nearest the lamp unit interior.

3. A sealed beam lamp unit as defined in claim 1 wherein said pair of opposing steps is located nearest the lamp unit exterior.

4. A sealed beam lamp unit as defined in claim 1 wherein each step of said pair of opposing steps, having one or more portions contacting each other along said long sides, is biplanar comprising a lower plane defined by said corners and short sides thereof and a higher plane defined by said long sides thereof.

5. A sealed beam lamp unit as defined in claim 1 wherein one of said pair of opposing steps, having one or more portions contacting each other along said long sides, is biplanar comprising a lower plane defined by said corners and short sides thereof and a higher plane defined by said long sides thereof.

6. A sealed beam lamp unit as defined in claim 4 or 5 wherein the height between said planes ranges from approximately 0.1 to 0.4 millimeters.

7. A sealed beam lamp unit as defined in claim 1 wherein said steps are substantially level.

8. A sealed beam lamp unit as defined in claim 1 wherein said steps are substantially transverse to the lamp unit axis.

9. A sealed beam lamp unit as defined in claim 1 wherein said lens and reflector materials are each selected from the group consisting of glass, quartz and plastic.

* * * * *